US009039574B2

(12) United States Patent
Wilson

(10) Patent No.: US 9,039,574 B2
(45) Date of Patent: May 26, 2015

(54) EXERCISE RING

(76) Inventor: Daniel Vaughan Wilson, Cedar Hills, UT (US)

( * ) Notice: Subject to any disclaimer, the term of this patent is extended or adjusted under 35 U.S.C. 154(b) by 479 days.

(21) Appl. No.: 13/494,027

(22) Filed: Jun. 12, 2012

(65) Prior Publication Data

US 2013/0331233 A1 Dec. 12, 2013

(51) Int. Cl.

| | |
|---|---|
| ***A63B 23/14*** | (2006.01) |
| ***A63B 23/16*** | (2006.01) |
| ***A63B 21/012*** | (2006.01) |
| ***A63B 21/045*** | (2006.01) |
| ***A63B 21/00*** | (2006.01) |
| ***A63B 21/002*** | (2006.01) |
| ***A63B 21/02*** | (2006.01) |
| ***A63B 23/12*** | (2006.01) |

(52) U.S. Cl.

CPC ..... *A63B 21/045* (2013.01); *A63B 23/14* (2013.01); *A63B 21/0004* (2013.01); *A63B 21/0023* (2013.01); *A63B 21/028* (2013.01); *A63B 21/1469* (2013.01); *A63B 23/1281* (2013.01); *A63B 23/129* (2013.01); *A63B 23/16* (2013.01); *A63B 2021/022* (2013.01); *A63B 2209/00* (2013.01)

(58) Field of Classification Search

CPC .... A63B 21/02; A63B 21/023; A63B 21/026; A63B 21/045; A63B 21/0455

USPC ..... 482/24, 44–50, 79, 91, 92, 121–128, 482/131, 139

See application file for complete search history.

(56) References Cited

U.S. PATENT DOCUMENTS

| | | | | |
|---|---|---|---|---|
| 3,655,185 | A * | 4/1972 | Kane | 482/125 |
| 4,090,706 | A * | 5/1978 | Reda | 482/122 |
| 4,690,401 | A * | 9/1987 | Cho | 482/122 |
| 4,856,776 | A * | 8/1989 | Ching-Liang | 482/122 |
| 5,342,273 | A * | 8/1994 | Plendl et al. | 482/126 |
| 5,681,243 | A * | 10/1997 | Criss | 482/49 |
| 6,932,747 | B2 * | 8/2005 | Herman | 482/126 |
| 2003/0139257 | A1 * | 7/2003 | Pemberton | 482/44 |
| 2009/0093352 | A1 * | 4/2009 | Krupa | 482/122 |
| 2011/0136633 | A1 * | 6/2011 | Riggs et al. | 482/121 |
| 2011/0172067 | A1 * | 7/2011 | Glauser et al. | 482/122 |

* cited by examiner

*Primary Examiner* — Oren Ginsberg
(74) *Attorney, Agent, or Firm* — Steven Rinehart

(57) ABSTRACT

A flexible ring is disclosed comprising one or more coiled springs and/or polymeric ring(s). In some embodiments, the coiled spring envelopes one or more inner coiled springs. In other embodiments, one or more handles circumscribe a portion of the outer coiled spring. Various embodiments of the present invention substitute flexible polymeric members for the coiled spring. In other embodiments, a disc is substituted for the polymeric ring(s).

6 Claims, 5 Drawing Sheets

EXERCISE RING

BACKGROUND OF THE INVENTION

1. Field of the Invention

This invention relates to exercise equipment, and more particularly relates to an exercise apparatus for building wrist and forearm strength.

2. Description of the Related Art

Businessmen and working fathers often lack to the time to exercise at commercial gymnasiums and find it more convenient to exercise at home. Standard exercise equipment is prohibitively large, expensive and cumbersome for home use. Many and varied types of compact exercise devices are available to help replace cumbersome gym equipment in home settings and assist individuals in their efforts to improve general strength, endurance and/or to mitigate specific health issues that need physical therapy, such as exercise balls.

The prior art includes complicated apparati comprising flexible rods, bungee cords, and inflatable or solid balls used for a large variety of conditioning activities such as cardiovascular and spinal therapy, as well as increasing core strength, and strengthening in the upper and lower body muscles. Some exercise devices employ elastic resistance as a means of developing or measuring strength. Often they are designed with a very limited exercises or muscle groups in mind, and are constrained by their own components and design to those limited areas. Certain muscles groups, such as the wrist muscles, have very few simple portable devices designed for their exercise or strength measurement, due to the difficulties in designing a simple apparatus that can correctly resist the supinating muscle motions leading to such development and measurement. Many patented portable devices that target difficult areas of the body to exercise such as these are complicated and difficult to find on the market.

There are no handheld devices in the art which target the muscles of a user's wrist and forearm, which a focus on supination, which can be stowed in a space as compact as a drawer. Thus it would be highly beneficial to provide a simple, compact portable device that targets the wrist and forearm region.

SUMMARY OF THE INVENTION

From the foregoing discussion, it should be apparent that a need exists for an exercise ring. Beneficially, such an exercise ring would overcome many of the difficulties with prior art by providing a more functional apparatus to consumers.

The present invention has been developed in response to the present state of the art, and in particular, in response to the problems and needs in the art that have not yet been fully solved by currently available apparati and methods. Accordingly, the present invention has been developed to provide a handheld exercise device comprising: one or more coiled spring(s) forming a ring of 4 inches to 26 inches in diameter; and two handles affixed to the ring, the handles disposed about the ring such the handles are diametrically opposed about the ring.

The ring may be twisted by a user to strengthen muscles and tendons in the wrist, hand, forearm, and shoulders. The ring may be stretched by a user to strengthen muscles and tendons in the wrist, hand, forearm, and shoulders.

The handles may comprise a sheath circumscribing the ring. The isotonic exercise device may further comprise a second coiled spring disposed within the coiled spring to increase resistance.

A handheld exercise device may comprise: a flexible polymeric ring of 4 inches to 26 inches in diameter; and one or more handle(s) affixed to the polymeric ring.

The ring may comprise one of a coiled spring and an elongated polymer member. The handle may comprise a sheath circumscribed the ring. The ring may be twisted by a user to strengthen muscles and tendons in the wrist, hand, forearm, and shoulders.

The ring may be stretched by a user to strengthen muscles and tendons in the wrist, hand, forearm, and shoulders. The ring may be affixed to one or more inner concentric ring(s) having a smaller diameter than a diameter of the ring.

A handheld exercise device is also disclosed comprising: a flexible polymeric disc of 4 inches to 26 inches in diameter; the disc defining one or more recesses for receiving the hands of the user.

The disc may be twisted by a user to strengthen muscles and tendons in the wrist, hand, forearm, and shoulders.

In sill further embodiments, the disc may be stretched by a user to strengthen muscles and tendons in the wrist, hand, forearm, and shoulders.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention.

One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
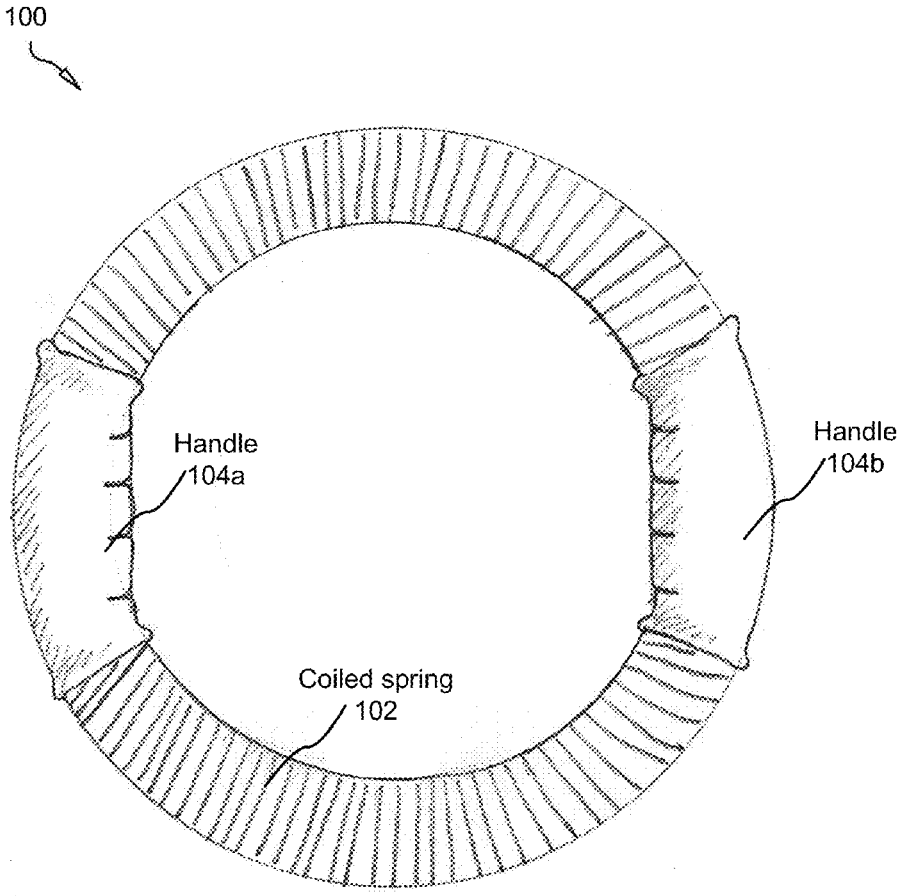
FIG. 1 is a top perspective view of coiled exercise ring in accordance with the present invention.

FIG. 1 is a top perspective view of coiled exercise ring 100 in accordance with the present invention. The ring comprises a coiled spring 102, a handle 104*a*, and a handle 104*b*.

The coiled spring 102 comprises a metallic or elastomeric spring with conjoined ends such that the entire coiled spring 102 forms a ring, loop, or tourus. The coiled spring 102 is wound tightly together such that significant human force or torque is required to flex it or stretch it out of its loop or ring shape.

The handles 104*a-b* comprise cylindrical members defining hollow passageways through which the coiled spring 102 is threaded. In some embodiments, the handles 104*a-b* are heat-pressed onto the coiled spring 102. In other embodiments, the handles 104 comprise only an outer skin overlaying or circumscribing the coiled spring 102.

Figure 2:
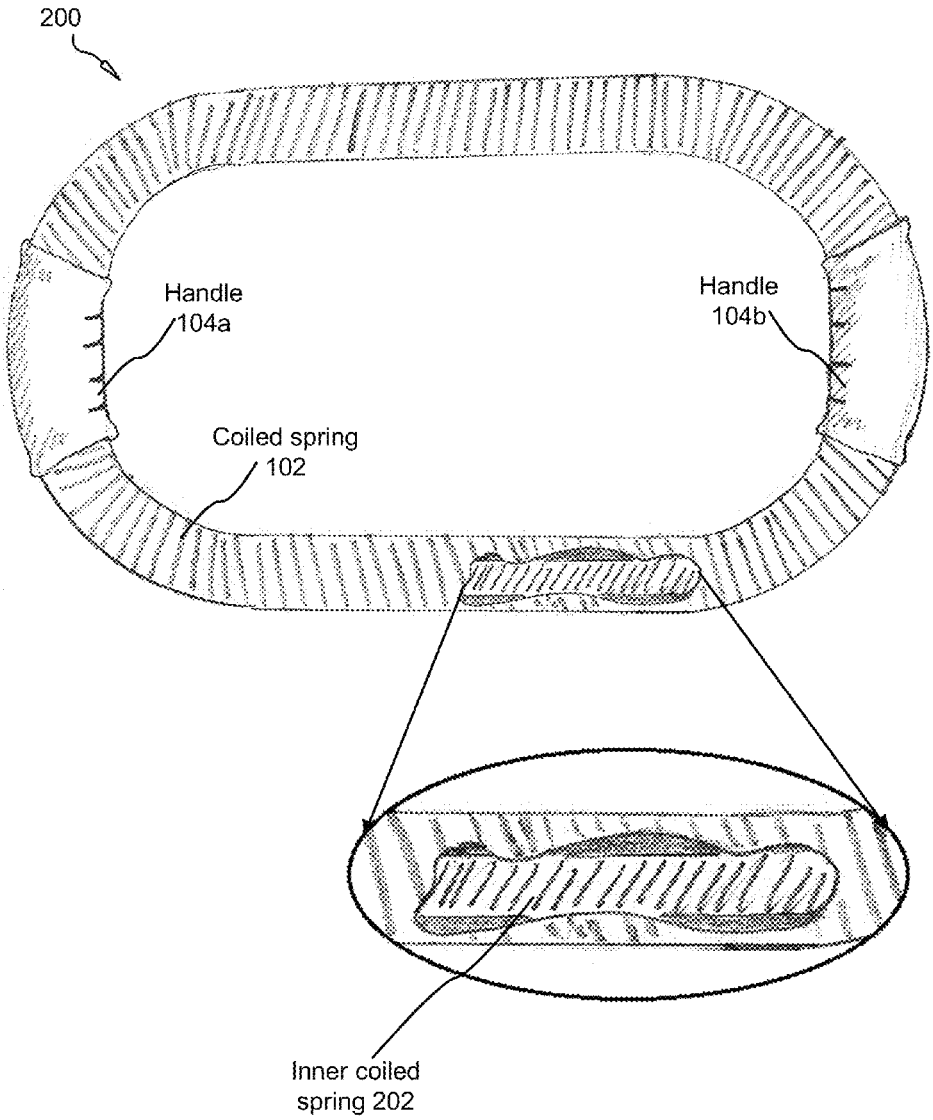
FIG. 2 is a top perspective view of coiled exercise ring in stretched position with exploded sectioned view in accordance with the present invention.

FIG. 2 is a top perspective view of coiled exercise ring 200 in stretched position with exploded sectioned view in accordance with the present invention. The ring 200 comprises a coiled spring 102, a handle 104*a*, and a handle 104*b*.

The term "torus" as used in this application may apply to any looped shaped, including a ring, but also including stretched donut-shaped objects, including objects with corners, facets, angles and the like.

The coiled spring 102 may comprise one or more inner coiled springs enveloped by the coiled spring 102. These inner coiled springs may be circumscribed by elastomeric skin to prevent the coils on an inner spring from becoming intertwined with the coils of an overlaying spring.

Figure 3:
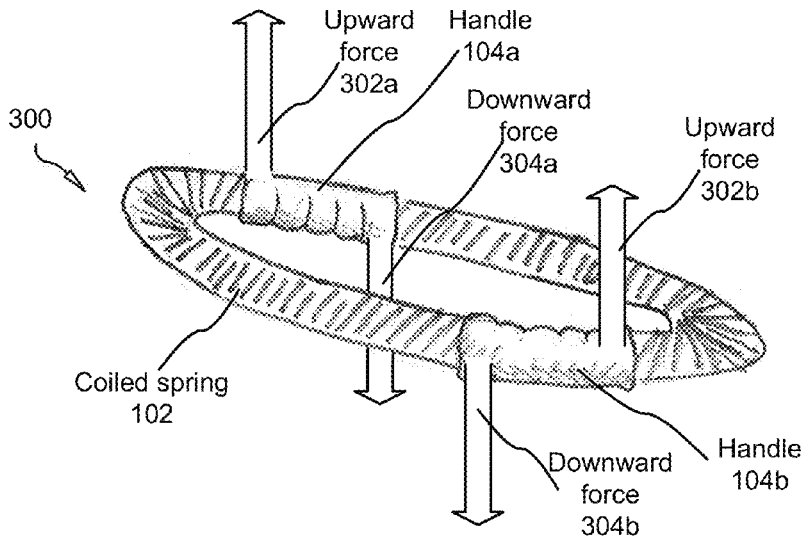
FIG. 3 is a top perspective view of forces applied by hand during proper use of a coiled exercise ring in accordance with the present invention.

FIG. 3 is a top perspective view of forces applied by hand during proper use of a coiled exercise ring 300 in accordance with the present invention. The forces applied to the coiled spring 300 include an upward force 302*a*, an upward force 302*b*, a downward force 304*a*, and a downward force 304*b*.

These forces 302-304 are applied to the handles 104*a-b* by the hands of user. The user twists, or torques, the handles in orthogonally opposed directions contorting the coiled spring 102, which resists the forces 302-304.

In some embodiments, the user compresses or stretches the ring 300 build strength using the hands, knees, elbows, and/or other parts of the user's body.

In some embodiments, the handles 104*a-b* may form one integrated piece the ring 300.

Figure 4:
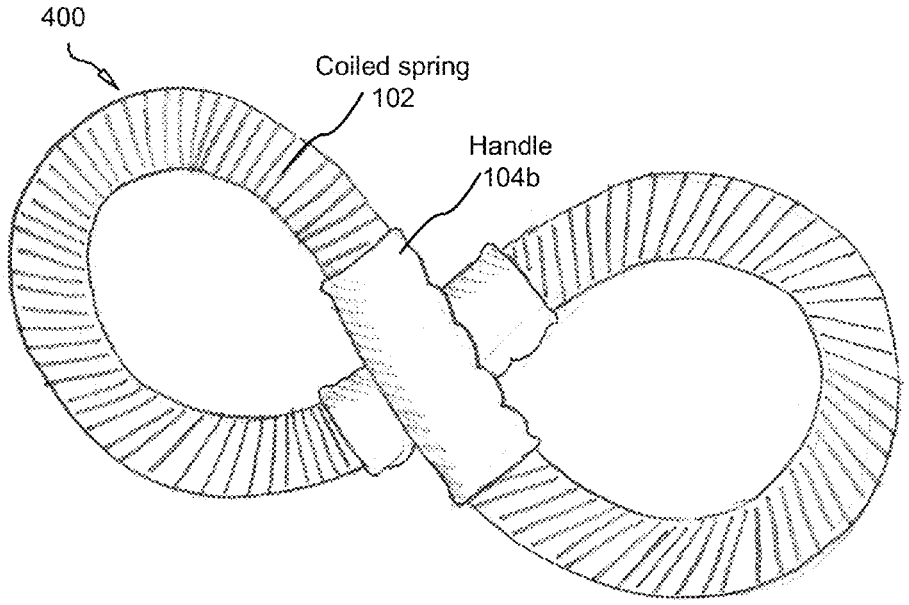
FIG. 4 is a top perspective view of a coiled exercise ring under torque in accordance with the present invention.

FIG. 4 is a top perspective view of a coiled exercise ring 400 under torque in accordance with the present invention.

The goal of the user contorting the ring 400 is force into figure-eight form as shown by applying the forces 302-304 substantially described above in relation to FIG. 3, thus building wrist and forearm strength.

Figure 5A:
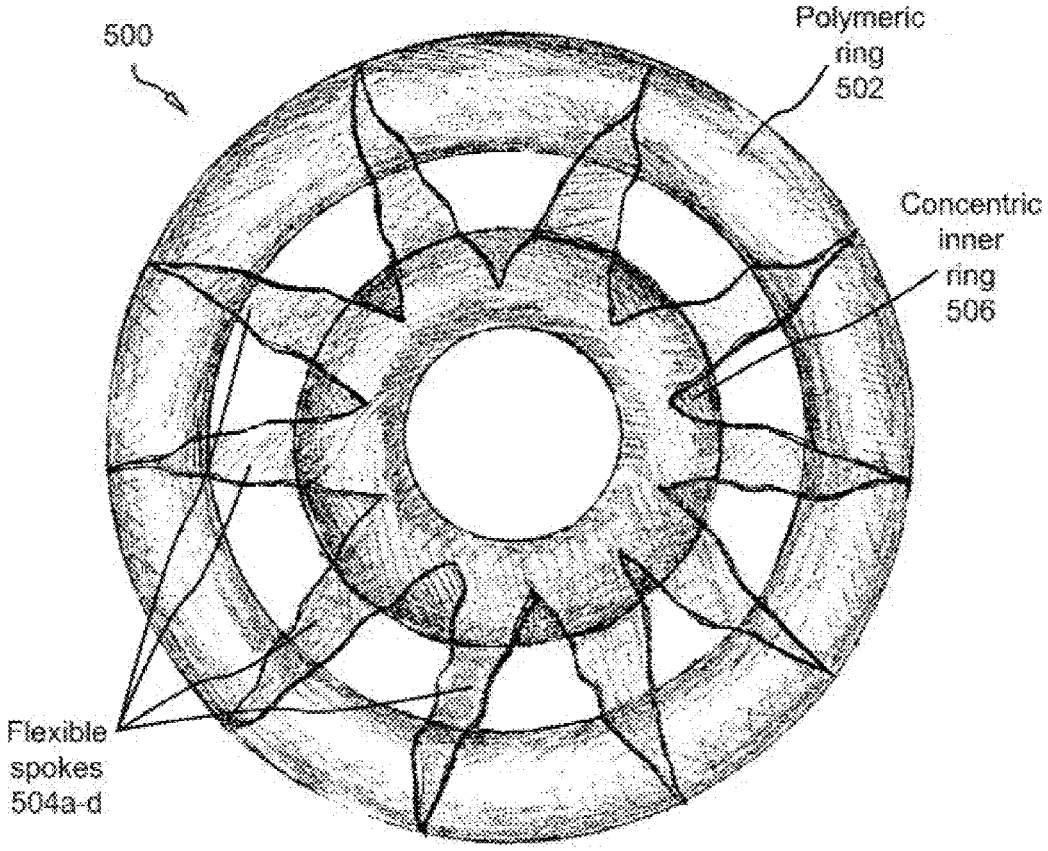
FIG. 5A is a top perspective view of a polymeric exercise ring in accordance with the present invention.

FIG. 5A is a top perspective view of a polymeric exercise ring 500 in accordance with the present invention. The exercise ring 500 comprises a polymeric ring 502, a plurality of flexible spokes 504, and an inner ring 506.

In the shown embodiment, a flexible polymeric tube, pipe, bar, or rod has replaced the coiled spring 102 in the embodied device. This polymeric tube 502 serves much the same function as the coiled spring 102. It can be twisted, contorted, flexed and/or stretched by a user to develop strength.

The device 500 also comprises one or more inner rings 506, which are interconnected with the polymeric ring 502 with a plurality of flexible spokes 504. These flexible spokes 504 may stretch to greater or lesser degrees than the polymeric ring 502. In the shown embodiment, they comprise translucent elastomeric film or skin. In other embodiments, they may comprise rods, shafts tubing, cord or the like.

In some embodiments, the device 500 comprises a disc rather than a series of concentric rings. The disc may have a planar top surface and/or a planar bottom surface. The top and bottom surfaces may be concave or convex in some embodiments. The disc may define recesses which are used to grip the disc.

Figure 5B:
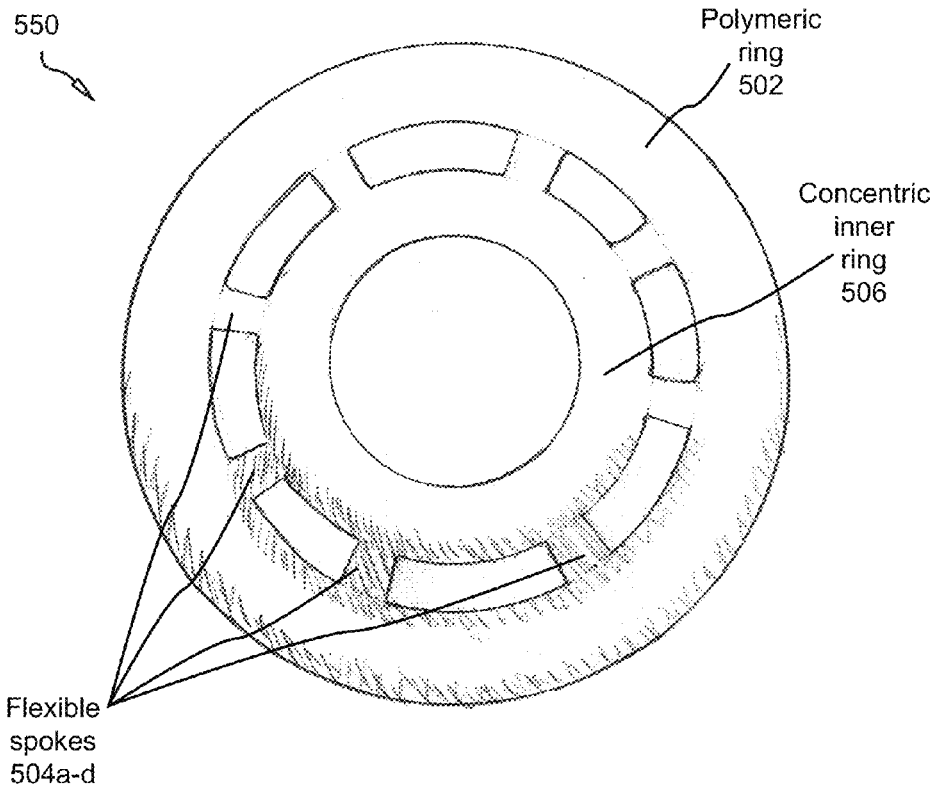
FIG. 5B is a top perspective view of a polymeric exercise ring in accordance with the present invention.

FIG. 5B is a top perspective view of a polymeric exercise ring 550 in accordance with the present invention. The exercise ring 550 comprises a polymeric ring 502, a plurality of flexible spokes 504, and an inner ring 506.

In the shown embodiment, the spokes 504*a-d*, the concentric inner ring 506, and polymeric ring 502 all form one integrated piece. The spokes 504*a-d* may be tubular or may comprise solid members such as bars.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A handheld exercise device comprising:

one or more coiled springs forming a ring of 4 inches to 26 inches in diameter; and two sheaths circumscribing the one or more coiled springs, the sheaths forming handles affixed to the ring, the handles disposed about the ring such the handles are diametrically opposed about the ring;

wherein the handles are torqued in orthogonally opposed directions forcing the exercise device out of its ring shape.

2. The isotonic exercise device of claim 1, wherein the ring is twisted, and not stretched, by a user to strengthen muscles and tendons in the wrist, hand, forearm, and shoulders.

3. The isotonic exercise device of claim 1, wherein the handles comprise a sheath circumscribing the ring.

4. The isotonic exercise device of claim 1, further comprises a second coiled spring disposed within the coiled springs to increase resistance.

5. A handheld exercise device comprising:

two collinear connected coiled springs of equal length forming one ring of 4 inches to 26 inches in diameter; and two handles affixed to the ring over connection points between the springs, each handle defining a hollow recess with two open ends for receiving the ring, the handles diametrically opposed about the ring;

wherein the handles are torqued in orthogonally opposed directions forcing the exercise device out of its ring shape.

6. The handheld exercise device of claim 5, wherein the ring is twisted by a user to strengthen muscles and tendons in the wrist, hand, forearm, and shoulders.

* * * * *